US011209141B2

(12) United States Patent
Chiang et al.

(10) Patent No.: US 11,209,141 B2
(45) Date of Patent: Dec. 28, 2021

(54) FLAMELESS CANDLE WITH SIMULATED FLAME AND WICK

(71) Applicant: Young March Co., Ltd., Irvine, CA (US)

(72) Inventors: Hsiu Ching Chiang, Ludao Township (TW); Alan Douglas Rushing, Irvine, CA (US)

(73) Assignee: YOUNG MARCH CO., LTD., Irvine, CA (US)

( * ) Notice: Subject to any disclaimer, the term of this patent is extended or adjusted under 35 U.S.C. 154(b) by 0 days.

(21) Appl. No.: 17/022,754

(22) Filed: Sep. 16, 2020

(65) Prior Publication Data

US 2021/0080070 A1 Mar. 18, 2021

Related U.S. Application Data

(60) Provisional application No. 62/927,487, filed on Oct. 29, 2019, provisional application No. 62/901,724, filed on Sep. 17, 2019.

(51) Int. Cl.
*F21S 10/04* (2006.01)
*F21S 9/00* (2006.01)
(Continued)

(52) U.S. Cl.
CPC ..... *F21S 10/043* (2013.01); *F21S 9/00* (2013.01); *F21V 3/00* (2013.01); *F21V 19/0015* (2013.01); *F21V 23/06* (2013.01); *F21Y 2115/10* (2016.08)

(58) Field of Classification Search
CPC ..... F21S 10/043; F21S 10/04; F21V 19/0015; F21V 23/06
See application file for complete search history.

(56) References Cited

U.S. PATENT DOCUMENTS 3,233,093 A 2/1966 Gerlat
4,510,556 A * 4/1985 Johnson ..... H05B 47/155 362/184
(Continued)

FOREIGN PATENT DOCUMENTS

CN 204 345 344 U 5/2015
CN 105 276 405 A 1/2016
FR 2 972 520 A1 9/2012

OTHER PUBLICATIONS

Extended European Search Report dated Feb. 11, 2021 for European Patent Application No. 20196377.4.

*Primary Examiner* — Bryon T Gyllstrom
*Assistant Examiner* — Christopher E Dunay
(74) *Attorney, Agent, or Firm* — Knobbe, Martens, Olson & Bear, LLP

(57) ABSTRACT

A simulated flame and wick device for use with a flameless candle and other devices requiring the appearance of a natural flame. A flame shaped housing, comprising an upper and lower cover, contains a flexible LED filament bulb, with the positive and negative leads passing through dedicated channels within a housing designed to have the appearance of a candle wick. The combination of the material used for the wick housing along with the positive and negative leads from the flexible LED filament bulb are designed to provide strength and flexibility to the wick component. In turn these leads pass through a positioning housing to orient the simulated flame and wick correctly when used with flameless candles and other devices. The simulated flame and wick along with the other components described are contained within the internal housing of a simulated candle shell or other appropriate device, thus simulating the appearance of a flame burning atop a blackened wick.

25 Claims, 14 Drawing Sheets

(51) Int. Cl.

| | |
|---|---|
| ***F21V 3/00*** | (2015.01) |
| ***F21V 19/00*** | (2006.01) |
| ***F21V 23/06*** | (2006.01) |
| *F21Y 115/10* | (2016.01) |

(56) References Cited

U.S. PATENT DOCUMENTS

| | | | | |
|---|---|---|---|---|
| 5,564,819 | A | 10/1996 | Yamaguchi | |
| 5,924,784 | A * | 7/1999 | Chliwnyj | F21K 9/232 362/234 |
| 6,336,733 | B1 | 1/2002 | Huang | |
| 7,850,346 | B1 | 12/2010 | Lauer | |
| 8,235,558 | B1 | 8/2012 | Lauer | |
| 8,408,746 | B1 * | 4/2013 | Lauer | F21S 10/04 362/284 |
| 8,602,610 | B1 | 12/2013 | Lauer | |
| 8,733,986 | B2 | 5/2014 | Hau et al. | |
| 8,845,144 | B1 * | 9/2014 | Davis | F21S 8/02 362/364 |
| 9,322,522 | B2 | 4/2016 | Hau et al. | |
| 9,322,523 | B2 | 4/2016 | Patton et al. | |
| 9,574,748 | B2 | 2/2017 | Dong | |
| 9,915,402 | B2 | 3/2018 | Dong | |
| 10,014,342 | B1 * | 7/2018 | Chen | H01L 27/153 |
| 10,731,809 | B1 * | 8/2020 | Mattausch | F21S 10/043 |
| 2004/0223326 | A1 * | 11/2004 | Wainwright | F21S 6/001 362/231 |
| 2005/0196716 | A1 * | 9/2005 | Haab | F21S 10/043 431/126 |
| 2006/0028828 | A1 | 2/2006 | Phillips | |
| 2007/0223216 | A1 | 9/2007 | Jensen et al. | |
| 2010/0067242 | A1 | 3/2010 | Fung | |
| 2017/0082255 | A1 * | 3/2017 | Bentley | F21S 10/043 |
| 2018/0003352 | A1 * | 1/2018 | Cao | F21V 3/062 |

* cited by examiner

FLAMELESS CANDLE WITH SIMULATED FLAME AND WICK

CROSS-REFERENCE TO RELATED APPLICATIONS

Any and all applications for which a foreign or domestic priority claim is identified in the Application Data Sheet as filed with the present application are hereby incorporated by reference under 37 CFR 1.57.

BACKGROUND

Field of the Disclosure

This disclosed technology relates generally to simulated flame lighting devices, such as flameless candles and candle-shaped electric lightbulbs.

Description of Certain Art

Flameless candles are electronic devices that simulate a traditional wick candle, which uses the flame of a burning wick to create light. Flameless candles use an electric light source, such as a light emitting diode (LED). Flameless candles do not require a flame and thus reduce the fire hazard risk associated with a traditional candle.

Because no wick is consumed during operation of a flameless candle, the operational lifetime of a flameless candle may be substantially longer than the lifetime of a traditional wick candle.

SUMMARY

In one broad aspect, a flameless candle device is provided, including a flame-simulating element including a cover defining a hollow cavity therein, first and second bulb leads, and a flexible light-emitting diode (LED) bulb disposed within the hollow cavity, a light-emitting section of the flexible LED bulb bent within the cavity such that a first portion of the light emitting section of the flexible LED bulb extends generally parallel to a second portion of the light emitting section of the flexible LED bulb, and a wick-simulating element supporting the flame-simulating element, the wick-simulating element including first and second discrete channels extending therethrough, the first and second bulb leads extending through the first and second discrete channels, respectively.

The cover may include an upper cover section and a lower cover section, the wick-simulating element extending through an aperture in the lower cover section. The upper cover section may be more opaque than the lower cover section. The lower cover section may be substantially transparent. An inner surface of the upper cover section may include a diffusive texture.

The device may additionally include a positioning holder supporting the wick-simulating element, where the first and second bulb leads are retained within the positioning holder. The device may additionally include a candle shell, where the positioning holder is embedded at least partially within the candle shell. The device may additionally include a circuit board disposed within the candle shell and in electrical connection with the flexible LED bulb through the positioning holder, and a power supply structure disposed at least partially within the candle shell.

In another broad aspect, a flameless candle device is provided, including a cover including an upper cover section, and a lower cover section secured relative to the upper cover section to define a hollow cavity and a flexible light-emitting diode (LED) bulb disposed within the hollow cavity, the flexible LED bulb bent into an elongated U-shape, a candle housing, a tube supporting the flame-simulating element away from the candle housing, and a positioning holder supporting the tube, the positioning holder disposed at least partially within the candle housing.

The positioning holder may include a first receptacle configured to receive and retain a positive lead extending from the LED bulb, and a second receptacle configured to receive and retain a negative lead extending from the LED bulb. The tube may include a first channel through which the positive lead extends and a second channel through which the negative lead extends, the first and second channels separated from one another along at least a portion of the length of the tube by an internal divider. The positioning holder may include a first internal connection between the positive lead and a first wire extending from the positioning holder and a second internal connection between the negative lead and a second wire extending from the positioning holder. The first receptacle may include a push-in receptacle in electrical communication with the first wire, and the second receptacle may include a push-in receptacle in electrical communication with the second wire.

In another broad aspect, a flameless candle device is provided, including a flame-simulating element including a cover including a hollow cavity, and a flexible light-emitting diode (LED) bulb disposed within the hollow cavity, the flexible LED bulb including a positive lead and a negative lead extending therefrom, a wick-simulating element supporting the flame-simulating element, the wick-simulating element including an insulating sheath including a first discrete passage through which the positive lead extends and a second discrete passage through which the negative lead extends, and a positioning holder supporting the wick-simulating element, the positioning holder disposed at least partially within the candle housing.

The positioning holder may include a first positioning holder component configured to engage with a second positioning holder component to retain portions of the positive and negative leads therebetween. The device may additionally include an internal sleeve disposed within the hollow cavity and surrounding at least a portion of the flexible LED bulb to prevent contact between the flexible LED bulb and the cover. The interior surface of the cover may include a diffusive texture.

The device may additionally include a printed circuit board and a power supply component in electrical communication with the LED bulb. The power supply component may include a lightbulb base. The power supply component may include a power cord.

In another broad aspect, a method of assembling a flameless candle component is provided, including inserting a first lead extending from a flexible light-emitting diode (LED) bulb into a first channel within a supporting tube, an exposed section of the first lead extending from an end of the supporting tube opposite the LED bulb, inserting a second lead extending from the flexible LED bulb into a second channel within the supporting tube, the second channel at least partially separate from the first channel by an internal divider within the supporting tube, an exposed section of the second lead extending from an end of the supporting tube opposite the LED bulb, inserting a portion of the supporting tube through an aperture in a light-transmissive component of a cover configured to encapsulate the LED bulb, and forming a positioning holder retaining a portion of each of the exposed sections of the first and second leads.

Forming a positioning holder retaining a portion of each of the exposed sections of the first and second leads may include forming a seamless positioning holder encapsulating the retained portions of each of the exposed sections of the first and second leads. Forming a seamless positioning holder may include molding a seamless positioning holder around the retained portions of each of the exposed sections of the first and second leads, after the supporting rube has been inserted through the aperture in the light-transmissive component of the cover.

Forming a positioning holder retaining a portion of each of the exposed sections of the first and second leads may include assembling a first discrete positioning holder component and a second discrete positioning holder component to retain the retained portion of each of the exposed sections of the first and second leads therebetween.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise.

Figure 1:
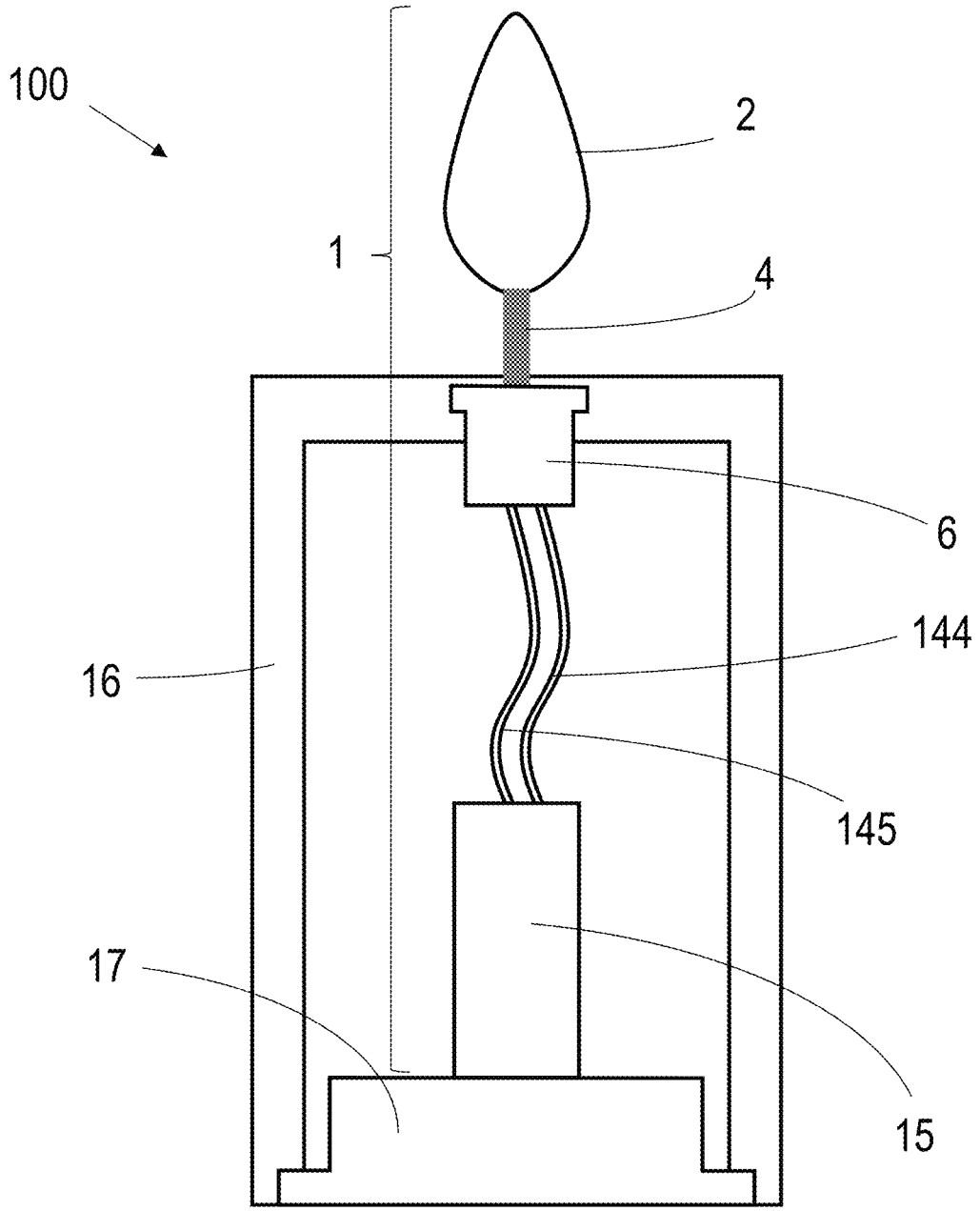
FIG. 1 is a cross-sectional view of an embodiment of a flameless candle incorporating a candle-simulating structure and a wick-simulating structure.

Where used in the various figures of the drawings, the same reference numerals designate the same or similar parts. Furthermore, when the terms "front," "back," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the subject of this disclosure.

All figures are drawn for ease of explanation of the basic teachings of the present technology only; the extensions of the figures with respect to number, position, relationship, and dimensions of the parts to form various embodiments will either be explained or will be within the skill of persons of ordinary skill in the art after the following teachings of the present disclosure have been read and understood. Further, the exact dimensions and dimensional proportions to conform to specific width, length, and similar requirements will likewise be within the skill of the art after the following teachings of the present disclosure have been read and understood.

Certain embodiments of the simulated flame and wick on an LED flameless candle according to the present disclosure will now be described in detail with reference to the accompanying drawings.

DETAILED DESCRIPTION

Various embodiments of flameless candles and flameless candle components are described herein. Some embodiments of flameless candles include a single diode LED concealed within a flame shaped cap, also referred to as a "flamecap," mounted directly to a wax surface of the flameless candle. Some embodiments of flameless candles include a "shroud" to cover a light source to simulate a flame, by utilizing movement of the shroud generated via a fan, pump or other source. Some embodiments of artificial candles include a light bulb that includes a single-sided LED strip and a simple black cover concealing wiring to the LED strip, to attempt to simulate a flame and a black wick.

These and other embodiments of flameless candles have drawbacks that limit their ability to achieve a more realistic simulation of a traditional wick burning candle. Embodiments of flameless candle which rely on a flamecap fail to deliver a realistic candle simulation, as the simulated flame appears to "float" on the top of the wick, and as the flamecap candle designs can lack a simulated black wick. Embodiments of flameless candles which rely on a shroud move in a manner which is inconsistent with the behavior of an actual flame, and require a dedicated power source in order to move the flame shroud. Embodiments of flameless candles which rely on a single sided LED strip generate light in an irregular pattern, due to the generation of light on only one side of the LED strip. In addition, the complexity of the components in various embodiments of flameless candles can hinder light output, preventing an effective simulation of an exposed candle flame. In embodiments of flameless candles which utilize thin wires and a simple black cover to simulate a wick, the wiring may not be strong enough to consistently maintain the flame in a realistic position vertically above the candle surface.

The drawbacks mentioned above have not been adequately addressed by existing flameless candle designs. Various embodiments of the disclosed technology address, at least in part, one or more of these deficiencies, or other deficiencies.

FIG. 1 is a cross-sectional view schematically illustrating an embodiment of a flameless candle. The flameless candle 100 includes a candle assembly 1 which is partially housed within a candle shell 16. The candle assembly 1 in the illustrated embodiment includes a flame-simulating element 2 supported by a wick-simulating element 4. In the illustrated embodiment, the wick-simulating element 4 extends partially into the upper surface of the candle shell 16, such that the wick-simulating element 4 and the flame-simulating element 2 are the only portions of the candle assembly 1 extending upward from the candle shell 16.

Within the candle shell 16, the wick-simulating element 4 is connected at its lower end to a positioning holder 6 or other suitable retention mechanism. In the illustrated embodiment, the positioning holder 6 is located within the upper surface of the candle shell to properly locate the flame-simulating element 2. The positioning holder may be exposed partially or concealed under another material, such as wax, to give a more realistic impression that the wick and flame are natural. The candle shell 16 may also have various shaped top surfaces such as, flat, domed, or recessed, which may be used to simulate the appearance of a candle that has been burned to some degree.

The positioning holder 6 is in turn connected via internal leads 144 and 145 to a printed circuit board (PCB) 15, which may comprise control circuitry and other suitable electronic components, as discussed in greater detail below. The PCB 15 is in electrical connection with a power source structure 17. In some embodiments, the positioning holder 6 may not be embedded below the upper surface of the candle shell 16 as illustrated, but may instead be flush with the upper surface of the candle shell 16, or arranged in any other suitable configuration relative to the candle shell 16. The positioning holder 6 and other components may be concealed within the candle shell 16.

In the illustrated embodiment, the candle shell 16 is generally cylindrical in shape, giving the flameless candle 100 the appearance of a pillar candle. In some embodiments, however, the candle shell 16 may have any other suitable shape to give the flameless candle 100 a desired appearance, including that of a tapered candle, a votive, a tea light, a figurine, or any other shape suitable for use as a candle. In some embodiments, the candle shell 16 may include real wax, such as paraffin wax, soy wax, beeswax, or another suitable wax. In some embodiments, the candle shell 16 may include a more durable material, such as resin, plastic, or any other material suitable to the intended application. In some particular embodiments, the candle shell 16 may include a combination of materials, such as a wax overlay over an underlying structure such as a plastic or resin structure.

Features of these flameless candles and components thereof may be utilized in conjunction with a wide variety of devices, which may be powered in any suitable fashion. For example, the flameless candles may utilize batteries as a power source. In some embodiments, the batteries may be removable or may be integrated batteries which are not intended to be replaced. The batteries may be replaceable, or may be rechargeable in any suitable fashion, including the use of a removable or integrated A/C power source, wireless recharging, solar recharging, or any other suitable recharging process. In some embodiments, the flameless candles may be directly powered, such as through the use of a hard-wired electrical cord or external power adapter, through the use of solar cells, or by utilizing a conventional lightbulb base or other electrical connector as described below with respect to FIG. 5.

In the illustrated embodiment, a portion of the power source structure 17 is exposed at the base of the candle shell 16. The exposed portion of the power source structure may include components with which a user can interact to power or control the operation of the flameless candle 100. For example, the power source structure 17 may include an on/off control, a timer control, or any other suitable control mechanism. These control mechanisms may include a switch, button, or any other suitable interface mechanism with which a user can interact. The power source structure 17 may also include an outwardly extending power cord, charging port or other socket for receiving a plug of a power adapter or cable, a battery receptacle and cover, or any other suitable mechanism for providing power to the candle assembly 1. In an embodiment in which a cord extends from or is configured to be connected to the power source structure 17, the cord may extend from a side of the candle shell 16, rather than the base of the candle shell 16.

Figure 2:
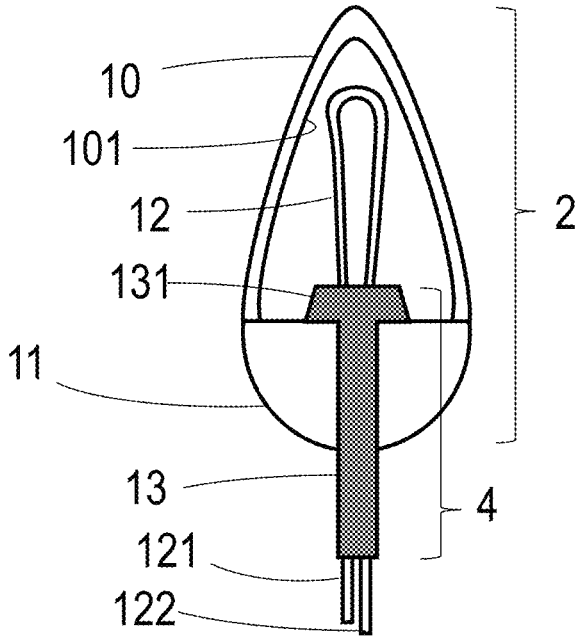
FIG. 2 is a cross-sectional side view illustrating an embodiment of a multidirectional flame-simulating element.

FIG. 2 is a cross-sectional view schematically illustrating a flame-simulating element and a wick-simulating element. In the illustrated embodiment, the flame-simulating element 2 includes a cover surrounding a light source, which in the illustrated embodiment is a flexible LED filament bulb 12 which serves as a multi-directional light-emitting element. In the illustrated embodiment, the cover includes an upper cover portion 10 and a lower cover portion 11. In some embodiments, these upper and lower cover portions 10 and 11 may be discrete elements which are bonded or otherwise connected together to form the cover encapsulating the bulb 12. In some embodiments, the discrete elements may be sealed together using glue, ultrasonic welding, a snap-fit or press-fit engagement, or any other suitable sealing method or combination of sealing methods.

In the illustrated embodiment, the lower cover portion 11 is generally rounded and somewhat spherical in shape, while the upper cover portion 10 is more elongated and somewhat conical in shape. Collectively, the upper and lower cover portions 10 and 11 resemble a natural candle flame undisturbed by airflow such as a breeze, or other outside influences.

The cover defines a hollow interior space in which the LED filament bulb 12 is positioned. In the illustrated embodiment, the LED filament bulb 12 is in the shape of a narrow arch, with both ends of the arched filament extending into a positioning head 131 at the upper end of the wick-simulating element 4, which can have an outwardly flared shape. The wick-simulating element 4 may include a sheath 13 which extends downward from the positioning head 131, and surrounds the positive lead 121 and the negative lead 122 extending from the bulb 12. In various embodiments, the wick-simulating element 4 comprises a tube, is elongated, and/or is hollow.

In some embodiments, the upper cover portion 10 may have a color that generally corresponds to the shell 16, such as a white or cream color, to provide a desired overall appearance in combination with the LED filament bulb 13. The LED filament bulb may, in some embodiments be a warm white color, or may range in color from a bright white to a yellow or yellowish-orange color, or be another color. Any other suitable colors for both the upper cover portion 10 and the LED filament bulb 13 may also be used to provide any desired appearance.

In some embodiments, a surface of the upper cover portion 10, such as the inner surface 101 of the upper cover portion 10, may comprise a texture or coating configured to affect alter the passage of light therethrough. In particular, the texture and/or coating may be configured to act as a diffuser to scatter the light emitted from the LED bulb 12. By diffusing the light, the appearance of localized bright spots will be reduced, balancing the light emitted by the LED bulb 12. In some embodiments, a diffusing texture or coating may be provided during a molding process for forming the upper cover portion 10.

In some embodiments, the lower cover portion 11 may be generally transparent or translucent with minimal tinting, to simulate the lack of color at the base of a natural candle flame. In some embodiments, the lower cover portion 11 may be similar or identical in color to the upper cover portion 10. Because the lower cover portion 11 may in some embodiments be clear or almost clear, the portion of the sheath 13 of the wick-simulating element 4 extending through the lower cover portion 11 may be visible. In some embodiments, the sheath 13 of the wick-simulating element 4 may in some embodiments be black, substantially black, brown or white, to simulate the appearance of a real candle wick. In some embodiments, the sheath 13 of the wick-simulating element 4 may include a texture on the outside surface to more accurately simulate the physical attributes of a real candle wick.

In some embodiments, the upper cover portion 10 and the lower cover portion 11 may comprise plastic, resin, or another suitable material which is sufficiently transparent to light. In some embodiments, the sheath 13 of the wick-simulating element 4 may comprise rubber, plastic, silicone, elastomer, or another other material that exhibits relative strength, flexibility and stiffness. The wick-simulating element 4 may fit snugly through an aperture in the lower cover portion 11, allowing the candle-simulating element 2 to be securely supported by the wick-simulating element 4. The material used for the wick-simulating structure 4, along with the positive and negative leads 121 and 122 extending from the flexible LED filament bulb 12 may combine to provide significant strength to the wick-simulating structure 4 in supporting the flame-simulating structure 2 in a desired orientation above the surface of an object to which it is attached, such as a candle shell or housing of a flameless candle.

Figure 3:
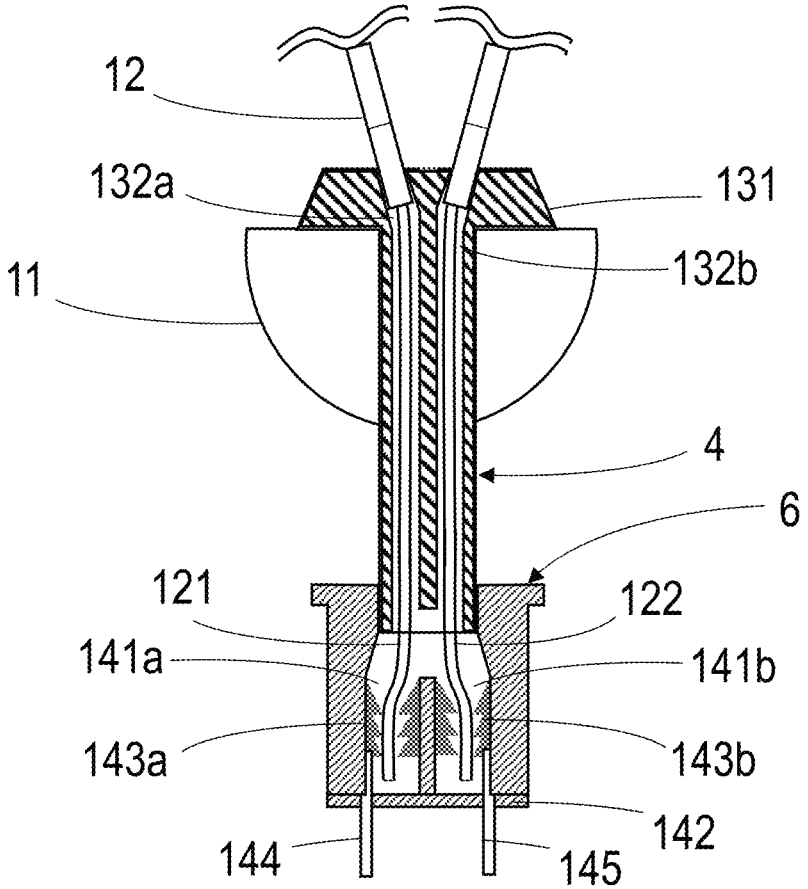
FIG. 3 is a cross-sectional side view of the flame-simulating element of FIG. 2, shown connected to a wick-simulating element and a positioning holder.

FIG. 3 is a cross-sectional view schematically illustrating a wick-seating element connected to a positioning holder. The wick-simulating element 4 is connected to the positive lead 121 and the negative lead 122 of the LED filament bulb 12. In particular, it can be seen that the positive lead 121 has been fed into a first dedicated channel 132*a* within the sheath 13 of the wick-simulating element 4, and that the negative lead 122 has been fed into a second dedicated channel 132*b* within the sheath 13. In the illustrated embodiment, the sheath 13 appears from the outside to be a single tube despite include discrete dedicated channels 132*a* and 132*b* extending at least a portion of the length of the sheath 13. These discrete dedicated channels 132*a* and 132*b* maintain a separation between the positive lead 121 and the negative lead 122 to isolate the positive lead 121 and the negative lead 122 from one another when power is provided to the flexible LED filament bulb 12.

The positive lead 121 and negative lead 122 of the flexible LED filament bulb 12 are inserted into the dedicated channels 132*a* and 132*b* of the sheath 13 of the wick-simulating element 4. The sheath 13 is then inserted downward through a hole in the lower cover, and the flared shape of the positioning head 131 at the top of the wick-simulating structure 4 prevents the wick-simulating structure 4 from sliding completely through the lower cover. In certain embodiments, the positioning head 131 provides stability, aids in assembly, and/or maintains the flexible LED filament bulb 12 in the proper position within the upper cover portion 10 of the flame-simulating element. In some embodiments, the positioning head 131 is pushed against and/or abutted with the lower cover portion 11. As can be seen in FIGS. 2 and 3, the positive lead 121 and negative lead 122 are longer than the sheath 13 and will extend beyond the bottom of the sheath 13.

The portions of the positive lead 121 and negative lead 122 which extend beyond the bottom of the sheath 13 are inserted into respective slots 141*a* and 141*b* within the positioning holder 6. Within the slots 141*a* and 141*b*, push-in receptacles 143*a* and 142*b* receive and retain the positive lead 121 and the negative lead 122. The push-in receptacles 143*a* and 143*b* in the illustrated embodiment comprise directional retaining structures, such as barbed conductors, which allow the positive lead 121 and the negative lead 122 to be inserted therein, while inhibiting their removal. In some embodiments, the push-in receptacles 143*a* and 143*b* permit movement of the conductors relative to the push-in receptacles 143*a* and 143*b* in one direction and inhibit or prevent movement of the conductors in an opposite direction. Each push-in receptacles 143*a* and 143*b* is electrically connected to a wire or other conductor, placing the retained positive lead 121 in electrical communication with the positioning holder positive lead 144, and placing the retained negative lead 122 in electrical communication with the positioning holder negative lead 145.

The bottom of the positioning holder 6 is, in the illustrated embodiment, sealed with the positioning holder bottom cap 142. The positioning holder bottom cap 142 can comprise a plurality (e.g., a pair) of through holes, through which the positioning holder positive lead 144 and the positioning negative lead 145 may pass. The positioning holder 6 and the positioning holder bottom cap 142 can comprise plastic, resin or any other material suitable for this purpose.

Figure 4:
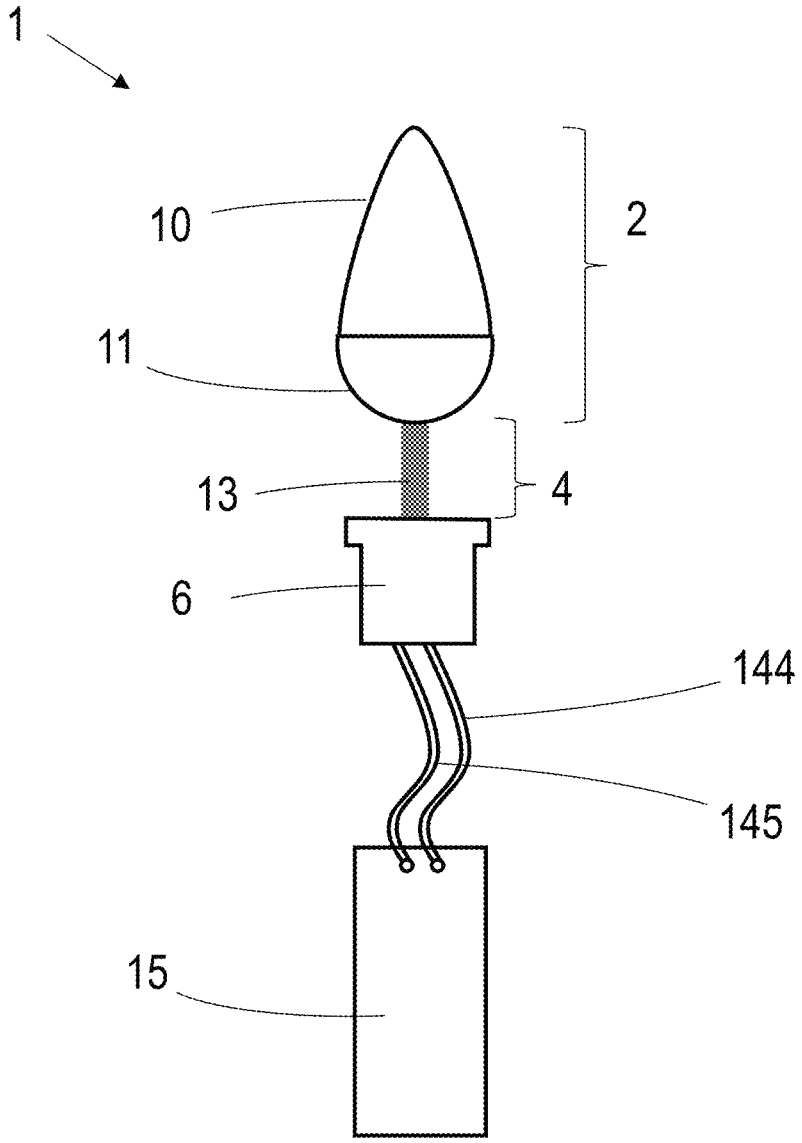
FIG. 4 is a cross-sectional view of a candle assembly, including a flame-simulating element, wick-simulating element and positioning holder such as those depicted in FIG. 3, connected to a printed circuit board (PCB).

FIG. 4 is a side view of a candle assembly including a flame-simulating element, a wick-simulating element and a positioning holder such as those depicted in FIG. 3, connected to a printed circuit board (PCB). The candle assembly 1 includes the upper cover portion 10 and the lower cover portion 11 of the flame-simulating element 2, the wick-simulating element 4, and the positioning holder 6. The positioning holder positive lead 144 and the positioning negative lead 145 are connected to a printed circuit board (PCB) 15.

Any suitable attachment mechanism or structure may be used to electrically connect the positioning holder positive lead 144 and the positioning negative lead 145 are connected to a printed circuit board (PCB) 15. For example, some embodiments may utilize male/female connectors, such as a plug/socket arrangement, soldering, push-in receptacles, or any other suitable method or structure.

The PCB 15 may comprise a variety of electronic controls and/or circuitry configured to control the operation of a flameless candle. For example, the PCB 15 may include control circuitry configured to control the operation of the LED bulb 12 to operate in a flickering pattern, to simulate the appearance and behavior of a real candle flame. The PCB 15 may include control circuitry configured to alter this flickering pattern in accordance with a given operating mode, as selected by a user. The PCB 15 may also include control circuitry configured to include automatic and/or variable timers for turning on and/or off the flameless candle, or for enabling reception of instructions from a remote control device to control the operation of the flameless candle.

A candle assembly such as the candle assembly of FIG. 4 can be integrated into (e.g., included in) a wide variety of devices to simulate the operation of a candle flame and wick. For example, a candle assembly can be integrated into a candle shell or housing such as the pillar candle shell 15 depicted in FIG. 1, to simulate a candle of a desired shape. In some embodiments, a candle assembly can be used in conjunction with other components to operate the candle assembly using an existing device or structure, such as a light socket.

Figure 5:
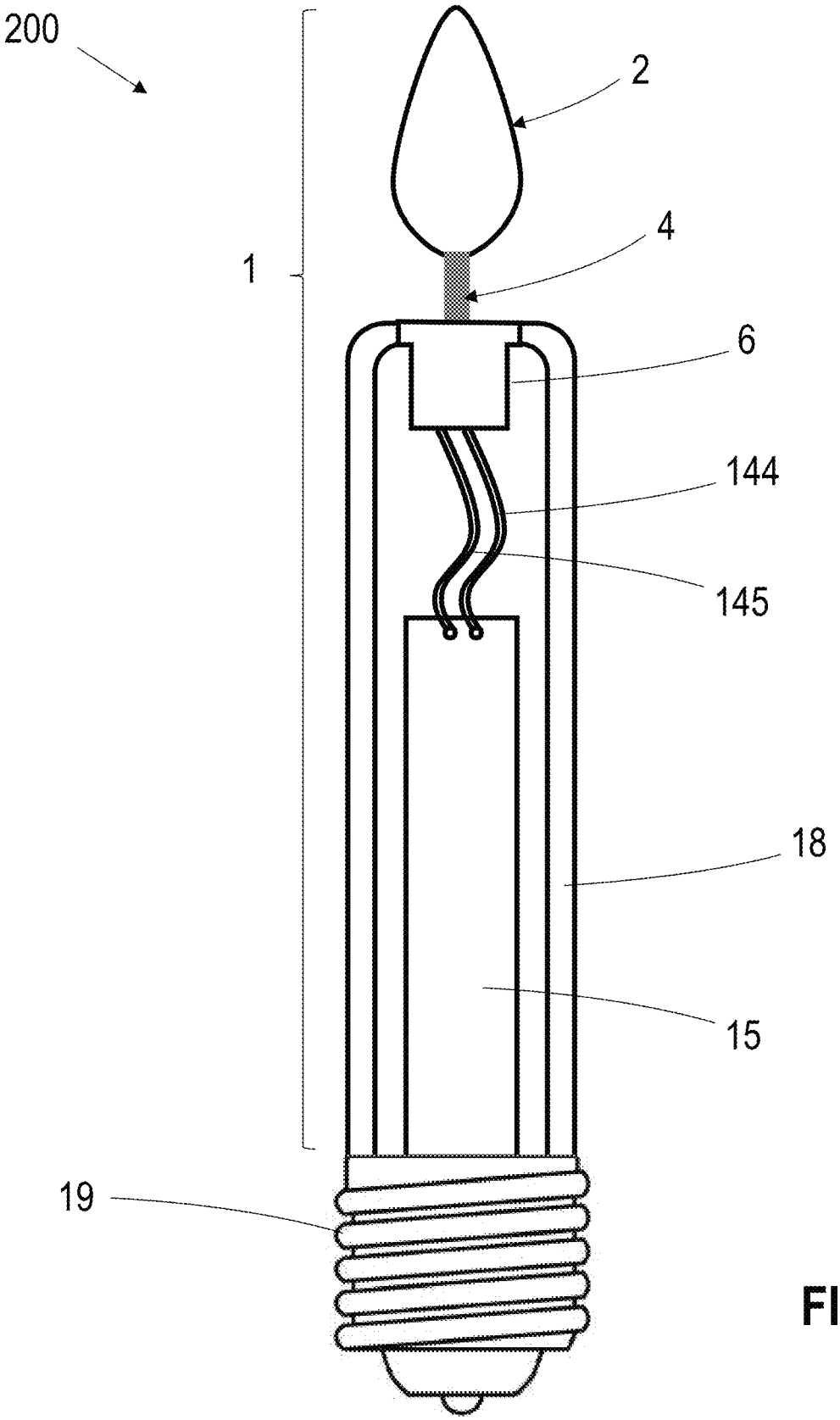
FIG. 5 is another cross-sectional view of an embodiment of a flameless candle incorporating a candle assembly such as the candle assembly of FIG. 3.

FIG. 5 is another cross-sectional view of an embodiment of a flameless candle incorporating a candle assembly such as the candle assembly of FIG. 3. The flameless candle device 200 of FIG. 5 includes a candle assembly 1 used in conjunction with a lightbulb base 19 to power the candle assembly 1. The candle shell 18 of flameless candle device 200 is a generally cylindrical shape having a narrower cross-section in comparison to the candle shell 16 of FIG. 1, Despite the narrower cross-sectional area, the bulk of the candle assembly 1 may nevertheless be retained within a cavity in the interior of the candle shell 18. The assembly 1 is arranged relative to the candle shell 18 such that the positioning holder 6 of the assembly is retained at least partially within the candle shell 18. In the illustrated embodiment, the upper surface of the positioning holder 6 is flush with the top of the candle shell 18, although in some embodiments the positioning holder 6 may be recessed within the candle shell 18, in a manner similar to that depicted in FIG. 1.

The PCB 15 at the lower portion of the assembly 1 is in electrical connection with a light bulb base 19. For example, positive and negative leads extending from the PCB 15 may be connected to the light bulb base 19 to allow electricity to operate the device when the light bulb base 19 is screwed or otherwise inserted into a light socket. The lightbulb base 19 may comprise, for example, any suitable lightbulb base, including but not limited to conventional light bulb base E12, E17, E26, B15, and G38 bases, among others.

Figure 6:
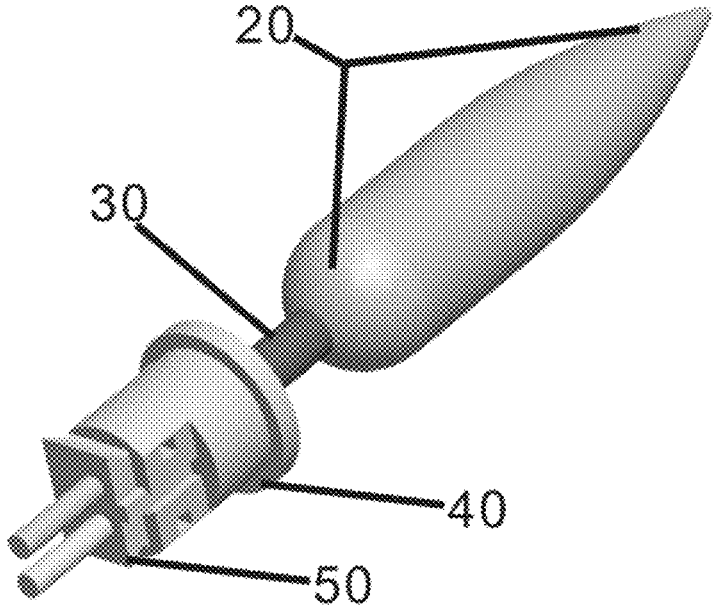
FIG. 6 is a perspective view of another embodiment of a flame-simulating element shown connected to a wick-simulating element, and positioning holder.

FIG. 6 is a perspective view of another embodiment of a flame-simulating element, a wick-simulating element, and a positioning holder. The cover 20 of the flame-simulating element is connected to a wick-simulating element 30. The wick-simulating element 30 is in turn connected to a positioning holder 40. In its assembled state, a male connector head 50 of the positioning holder 40 can be used to connect to a PCB (not shown).

Figure 7:
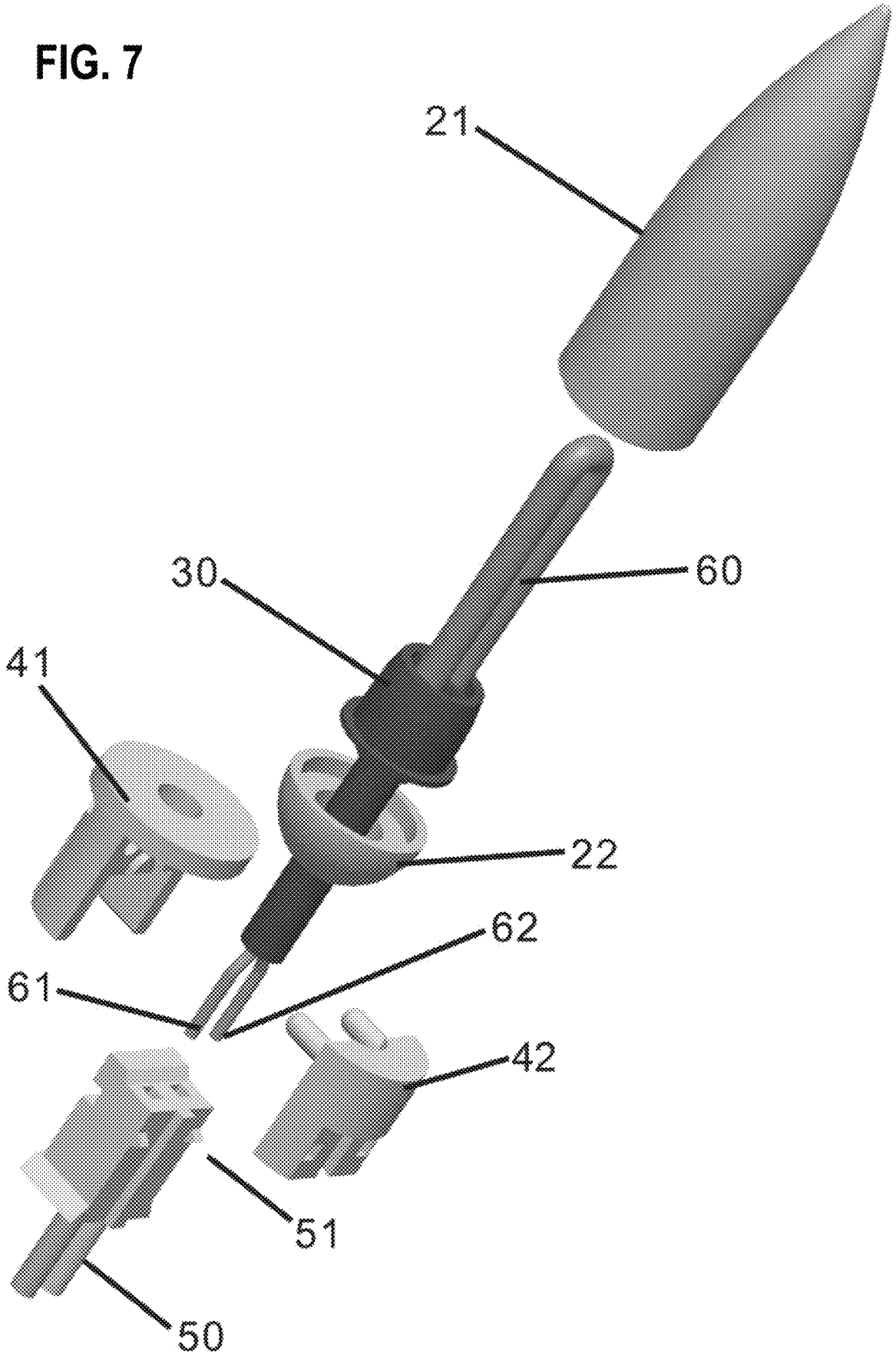
FIG. 7 is an exploded assembly view of certain components of a flame-simulating element, a wick-simulating element, and a positioning holder.

FIG. 7 is a perspective exploded assembly view of the flame-simulating element, the wick-simulating element, and the positioning holder of FIG. 6, illustrating certain components of these structures. The flame cover 20 of the flame-simulating element includes an upper flame cover 21 and a lower flame cover 22. A flexible LED filament bulb 60, which in the illustrated embodiment is bent into a narrow inverted U-shape, is arranged such that a negative lead 61 and a positive lead 62 extend through dedicated channels within the wick-simulating element 30.

The negative lead 61 and a positive lead 62 extend beyond the base of the wick-simulating element 30. The positioning holder 40 (see FIG. 6) includes a female positioning holder component 41 and a male positioning holder component 42. In the illustrated embodiment, the negative lead 61 and a positive lead 62 are inserted into an opening in an upper surface of the female positioning holder component 41. The male positioning holder component 42 secures the negative lead 61 and a positive lead 62 into position, minimizing the likelihood that the negative lead 61 and a positive lead 62 can be pulled out.

A male connector head 50, which may be connected to wiring extending between the male connector head 50 and a PCB, is configured to be inserted into the bottom of the positioning holder 40. This connection can complete the electrical connection from the male connector head 50 to the flexible LED filament bulb 60. The male connector head 50 has two outwardly extending locking teeth 51 that may be used to engage locking teeth receptacles 422 (see FIG. 9) in the male positioning holder component 42.

Figure 8:
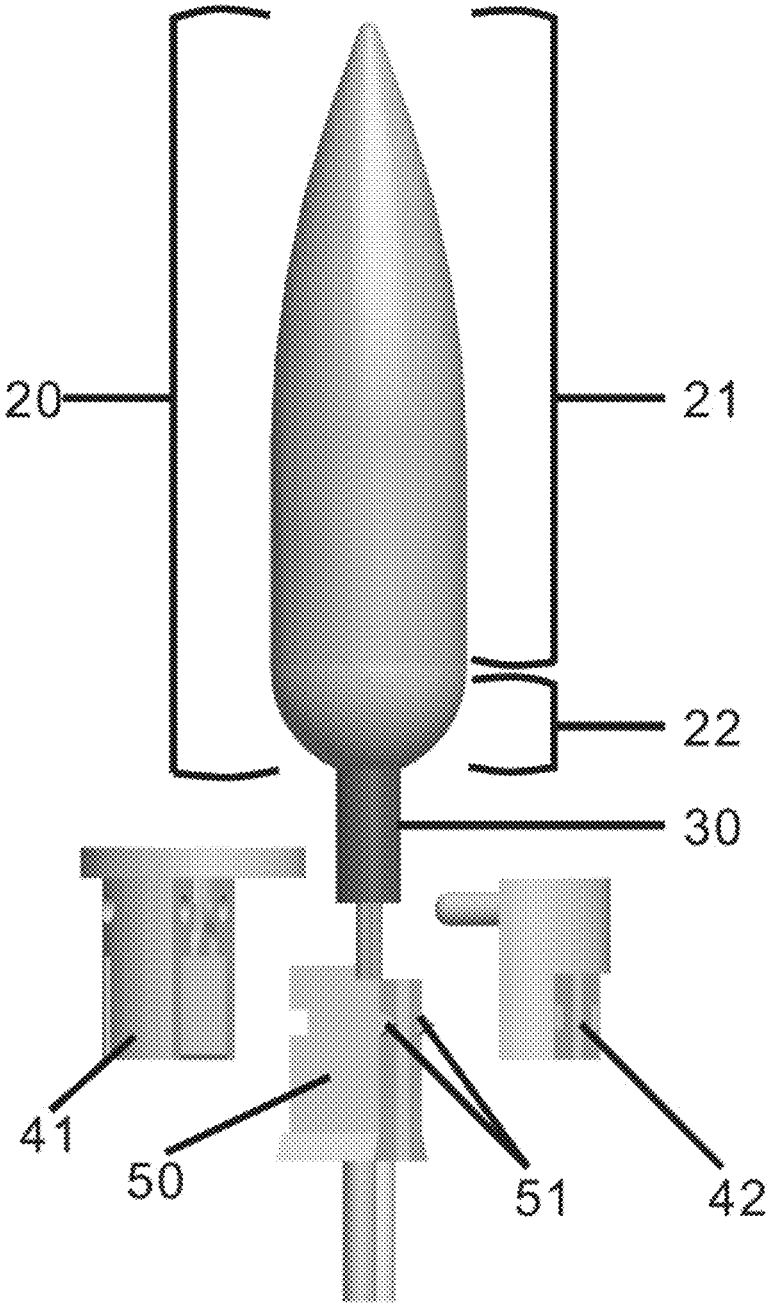
FIG. 8 is partially exploded view of the flame-simulating element, wick-simulating element, and positioning holder of FIG. 7, with the flame-simulating element and wick-simulating element in an assembled configuration, and the positioning holder in an exploded view.

FIG. 8 is a partially assembled view of the components of FIG. 7. In FIG. 8, the flame cover 20 of the flame-simulating element is shown in an assembled view, in which the upper cover portion 21 abuts the lower cover portion 22. The positive and negative leads extending from the base of the wick-simulating element 30 are inserted into the male connector head 50, with the female positioning holder component 41 and a male positioning holder component 42 shown in an exploded state on either side.

Figure 9:
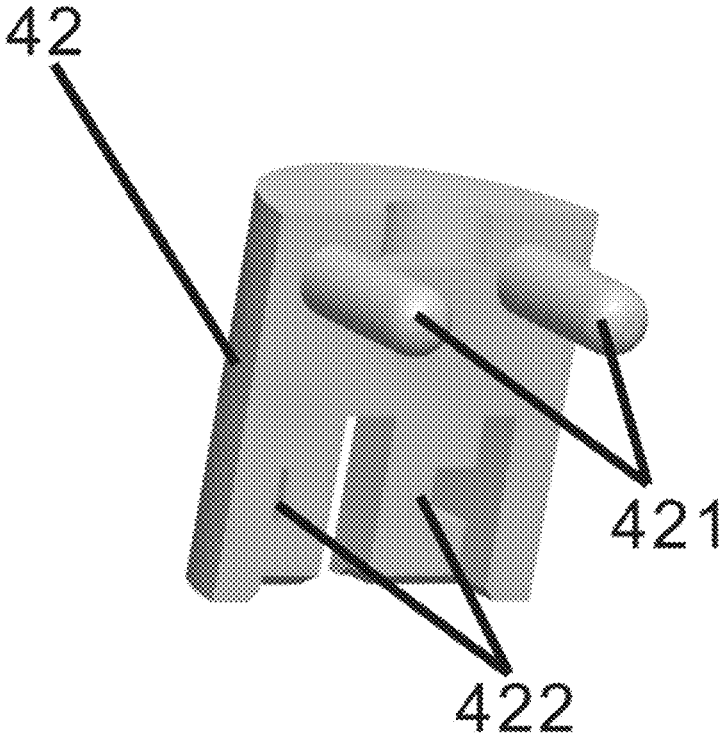
FIG. 9 is an internal view of a male half of an embodiment of a positioning holder.

FIG. 9 is a perspective view of the male positioning holder component of FIG. 7. In particular, FIG. 9 provides an interior view of the male positioning holder component 42. It can be seen in FIG. 9 that the male positioning holder component 42 comprises two outwardly extending pins 421 configured to engage corresponding receptacles in the female positioning holder component 41 (see FIG. 10). Locking teeth receptacles 422 are configured to engage with the locking teeth 51 of the male connector head 50 (see FIGS. 7 and 8).

Figure 10:
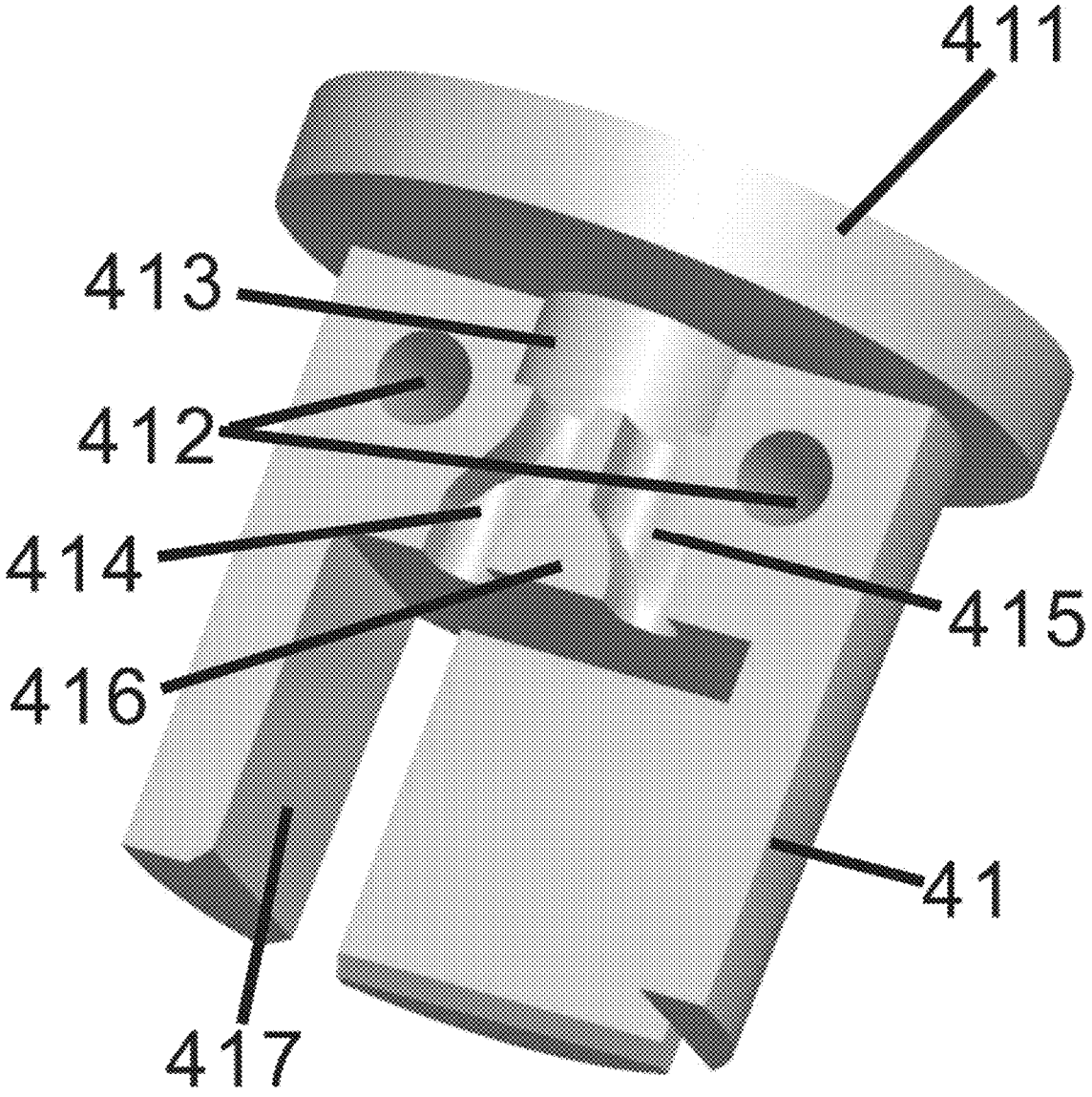
FIG. 10 is an internal view of a male half of an embodiment of a positioning holder, configured to receive the male half of the positioning holder of FIG. 9.

FIG. 10 is a perspective view of the female positioning holder component of FIG. 7. The female positioning holder component 41 of the illustrated embodiment includes a cap 411. While certain embodiments of flameless candles described herein recess the positioning holder beneath a surface of a candle shell or other structure, in some embodiments, a cap 411 or other structure can be used as a finished external part, visible to the user, depending on the design of the specific product.

The cap 411 includes a hole 413 in the center of the cap 411. The hole 411 connects to a lower section of the female positioning holder component 41 in which the hole separates into discrete channels spaced apart from one another by a divider 416. The negative lead channel 414 and positive lead channel 415 on either side of the divider 416 guide the respective negative lead 61 and a positive lead 62 from the flexible LED filament bulb 60 to engage with the connector head 50 configured to be retained at least partially within the connector head receptacle 417.

The female positioning holder component 41 includes two female receptacles 412 that receive the male pins 421 from the male positioning holder component 42, One or both of the male pins 421 or the female receptacles 412 may comprise detents or other contour features to improve tension when these parts are press-fit together. When the female positioning holder component 41 and the male positioning holder component 42 are pressed together, the positive and negative leads 61 and 62 are compressed therebetween, retaining the leads in place.

Figure 11:
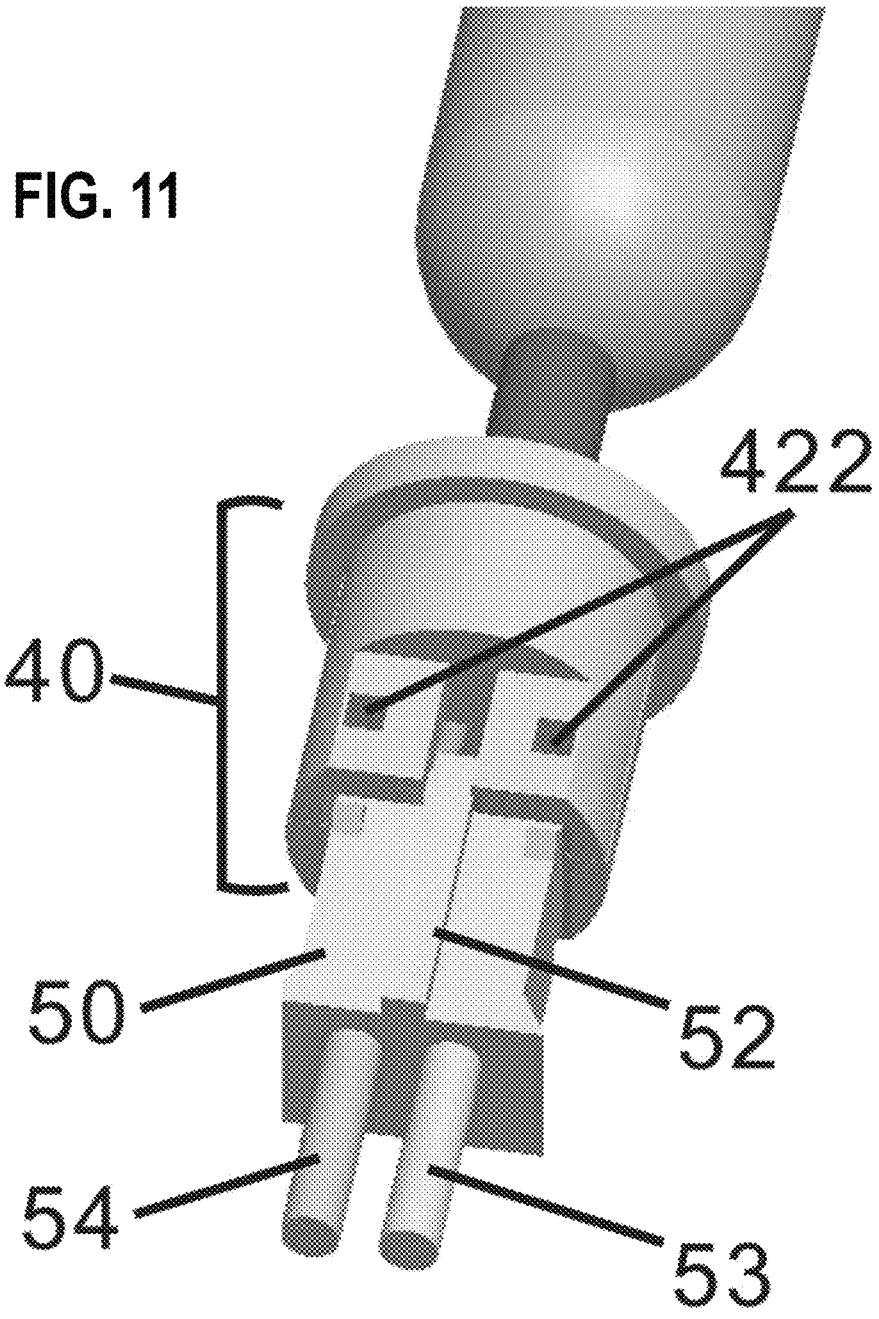
FIG. 11 is a perspective view an assembled embodiment of a positioning holder completely, with a connector head of wiring to the PCB in position.
Figure 12:
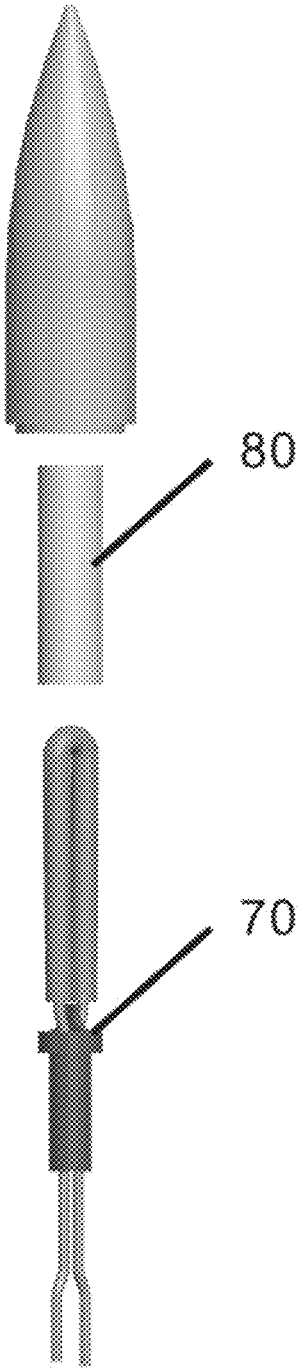
FIG. 12 is a perspective view schematically illustrating another embodiment of a flame-simulating element and a wick-simulating element.
Figure 13:
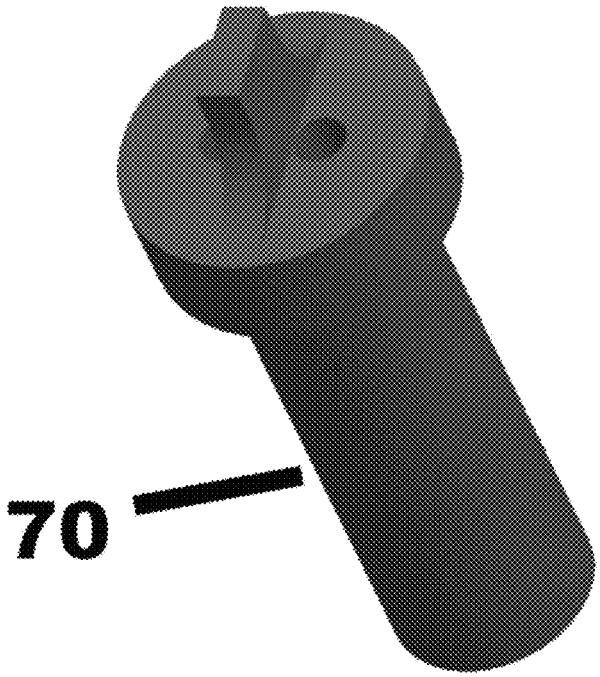
FIG. 13 is a perspective view of the wick-simulating element of FIG. 12.

FIG. 11 is a perspective view of the connector head inserted into the lower portion of the assembled positioning holder. The connector head 50 in this illustrated embodiment comprises an orientation guide 52 in the form of a ridge to ensure that the connector head 50 is properly oriented when inserted into the positioning holder 40. Ensuring the correct orientation of the connector head 50 relative to the positioning holder 40 will ensure that the positive wire 53 extending from the connector head 50 is connected to the positive lead 61 extending from the flexible LED bulb 12, and that the negative wire 54 extending from the connector head 50 is similarly connected to the negative lead 62. The locking teeth 51 (see FIG. 7) of the connector head 50 are configured to engage the locking teeth receptacles 422 in the positioning holder 40 to ensure a secure connection without the need for soldering FIG. 12 is a perspective view schematically illustrating another embodiment of a flame-simulating element and a wick-simulating element. FIG. 13 is a perspective view of the wick-simulating element of FIG. 12. In contrast to the wick-simulating element 30 of FIG. 7, which includes a positioning head surrounding the base of the flexible LED bulb 60, the wick-simulating element 70 does not provide direct lateral support to the flexible LED bulb 60. Instead, the structure of FIG. 12 includes a sleeve element 80 which may be dimensioned to press-fit onto the wick-simulating element 70. The sleeve element 80 may provide lateral support to retain the flexible LED bulb 60 in a desired position within the upper cover portion. In some embodiments, the sleeve element 80 may be transparent or translucent, and may include diffusing structures or coatings, tinting, or any other suitable feature or mechanism which may alter the appearance of the flexible LED bulb 60.

The use of an internal sleeve element 80 and the alternate design of wick-simulating element 70 may improve the overall performance of a flameless candle device. The sleeve element 80 may ensure that the flexible LED bulb 60 remains spaced apart from the interior surface of the upper cover portion, preventing the incidence of localized bright spots. In addition, because the wick-simulating element 70 does not block the light-emitting portions of the flexible LED bulb 60 near the base of the flexible LED bulb 60, the overall brightness of the flameless candle can be increased.

The overall dimensions of a flameless candle device may place structural constraints on the type of components that may be included in the flameless candle device. For example, while a candle shell dimensioned to correspond to a relatively large pillar candle may have ample space within the candle shell to house desired components, other flameless candle devices may be smaller. For example, in an embodiment where a candle shell is dimensioned to correspond to a tea light or votive candle, there may not be sufficient space within the design to include all of the elements of certain candle assemblies described herein. For example, in some such embodiments, the positioning holder may be omitted. In such an embodiment, a thicker wick-simulating structure or wiring may be used to provide additional structural support, or the wick-simulating structure may be supported directly by another component, such as the PCB or a power source structure. Even without the additional support provided by the use of the positioning holder, embodiments including certain of the other features described herein may provide a flameless candle device which more effectively simulates a natural burning flame.

Figure 14:
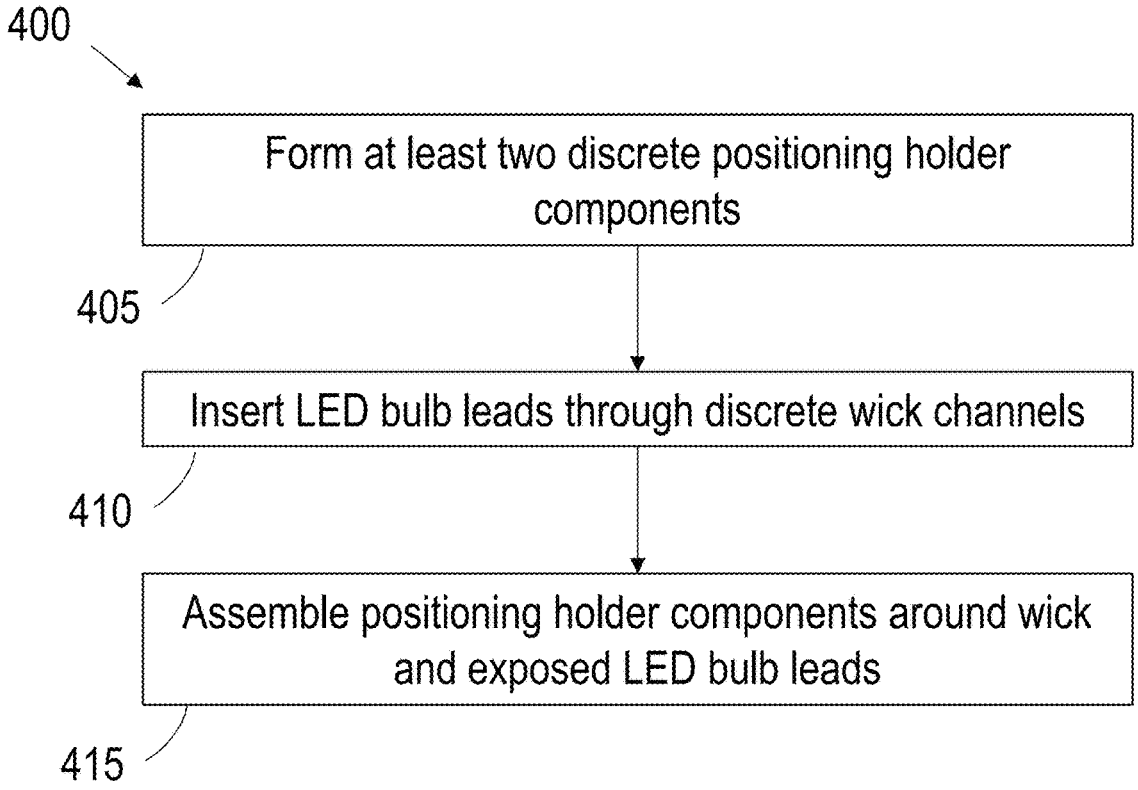
FIG. 14 is a process flow diagram schematically illustrating an example process for assembling a component of a flameless candle.

In some embodiments discussed herein, a positioning holder may be assembled by forming a plurality of separately molded or formed components and assembling those components in a manner which retains at least a portion of the LED bulb leads therein. FIG. 14 is a process flow diagram schematically illustrating an example process for assembling a component of a flameless candle.

The process 400 begins at a stage 405, where at least two positional holder components are formed as discrete components. These discrete positional holder components may be formed, for example, in two distinct molding processes, or as separate components formed in a single molding process. Specific embodiments of such discrete positional holder components are illustrated in FIGS. 9 and 10, although a wide variety of other multicomponent positional holder designs can be used in other embodiments.

The process then moves to a stage 410, wherein the leads of an LED filament bulb are inserted through discrete channels in a wick-simulating element and the wick is inserted through an aperture in a portion of a flame-simulating cover. An example of the resulting structure is illustrated in FIG. 7, in which the leads 61 and 62 of the LED bulb 60 have been inserted through discrete channels in the wick-simulating structure 30, and a portion of the wick-simulating structure 30 has been inserted through an aperture in the lower cover portion 22 of the flame simulating cover. Once inserted into the wick-simulating structure, portions of the bulb leads extend from the end of the wick-simulating element opposite the LED bulb. While illustrated as occurring after stage 405, some or all of the processes described with respect to stage 410 may be performed before some or all of the processes described with respect to stage 405.

The process then moves to a step 410, where the discrete positional holder components are brought together to retain portions of the exposed ends of the LED leads therebetween, forming a positional holder which supports the wick-simulating structure and the LED bulb and cover supported thereon. Subsequently, connections may be made with a PCB to form a candle assembly as described above, and the candle assembly may be integrated into a candle shell and connected to a power source to form a suitable flameless candle device. The assembly of the discrete positional holder components allows the assembly of the flameless candle components to be completed after all of the individual components have been fabricated.

Figure 15:
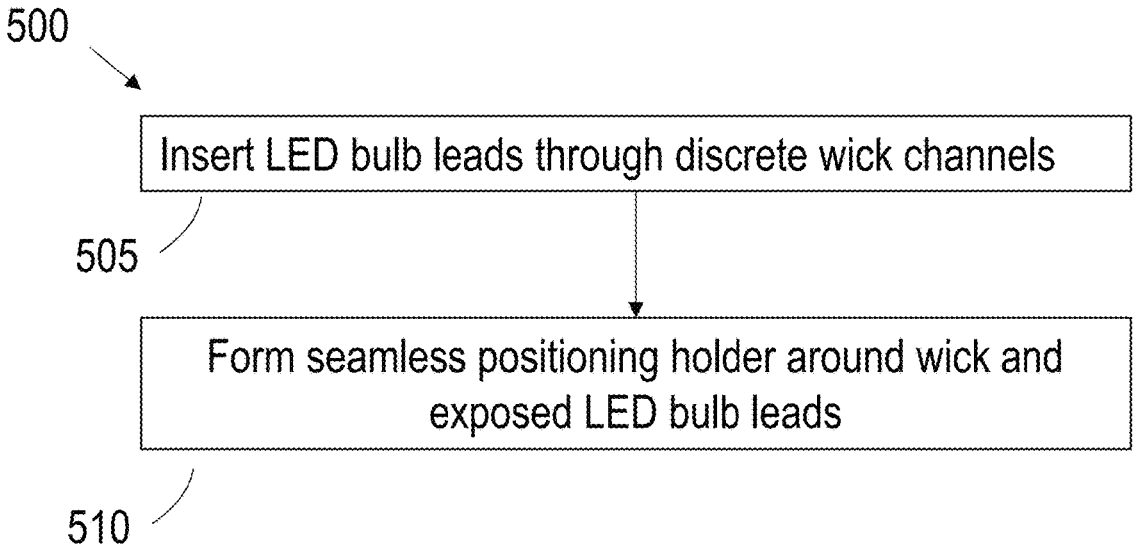
FIG. 15 is a process flow diagram schematically illustrating an example process for assembling a component of a flameless candle.

In some embodiments, however, the positioning holder may be molded as a single component. In some particular embodiments, the positioning holder may be molded in situ around the leads of the LED filament bulb, which may reduce the labor required to assemble a flameless candle device. FIG. 15 is a process flow diagram schematically illustrating an example process for assembling a component of a flameless candle.

The process 500 begins at a stage 505 where the leads of an LED filament bulb are inserted through discrete channels in a wick-simulating element and the wick is inserted through an aperture in a portion of a flame-simulating cover.

The process then moves to a stage 510 where a seamless positional holder is formed. In contrast to the position holders formed from interlocking position holder components assembled around portions of the LED bulbs, a seamless positional holder will not require assembly of the positioning holder after production. In some embodiments, the seamless positional holder is formed in situ around portions of the LED bulb leads. In some embodiments, one or more spacer elements may be inserted onto one more both of the LED bulb leads to maintain the bulb leads in a desired arrangement during the molding process, and the seamless position holder may be molded over the spacer element or elements. In some embodiments, a mold used to form the seamless position holder may include a retention figure configured to retain a portion of the LED bulb leads for consistency in manufacturing.

Figure 16A:
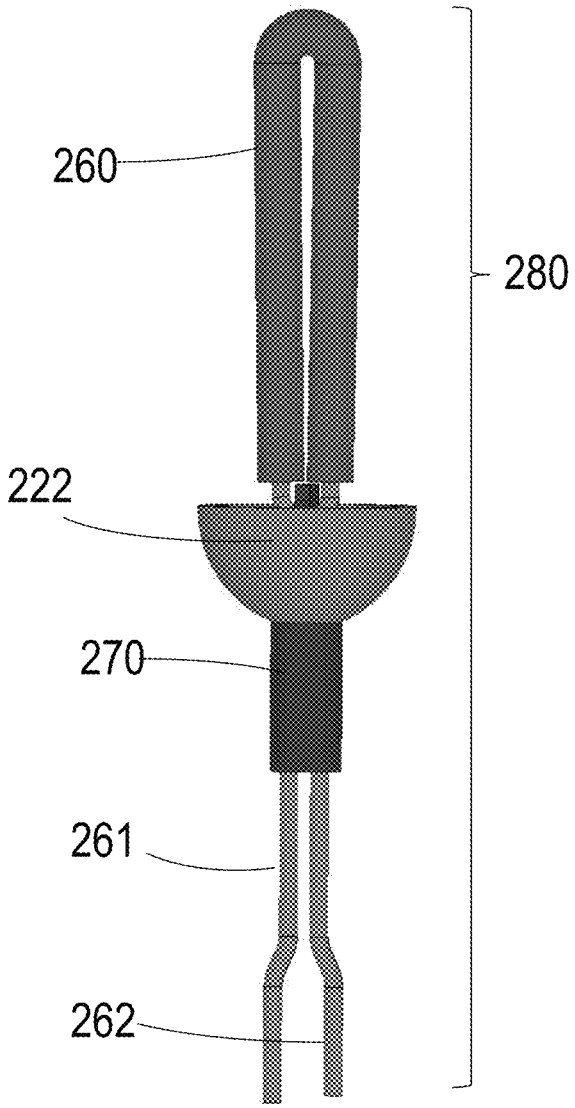
FIG. 16A is a side view of an embodiment of a bulb, cover, and wick assembly prior to the formation of a seamless positioning holder.
Figure 16B:
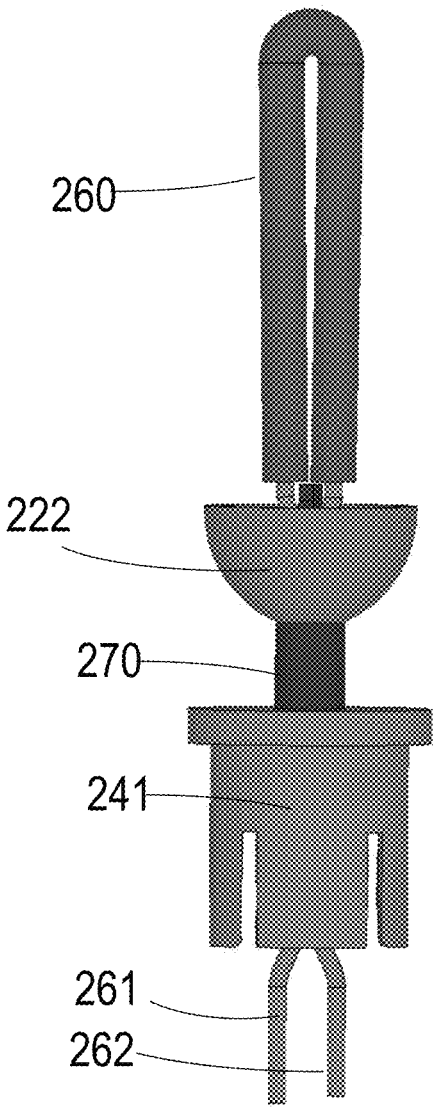
FIG. 16B is a side view of the embodiment of the bulb, cover, and wick assembly after the formation of a seamless positioning holder.

FIG. 16A is a side view of an embodiment of a bulb, cover, and wick assembly prior to the formation of a seamless positioning holder. FIG. 16B is a side view of the embodiment of the bulb, cover, and wick assembly after the formation of a seamless positioning holder. In FIG. 16A, it can be seen that the leads 261 and 262 extending from a filament LED bulb 260 have been inserted into discrete channels within a tube that serves as at least a portion of a wick-simulation structure 270. A portion of the wick-simulation structure 270 has been inserted through an aperture in a lower cover portion 222, forming an intermediate assembly 280 In some embodiments, although not illustrated specifically herein, an upper portion of the cover may be sealed to the lower cover portion to provide a flame-simulating cover encapsulating the LED bulb 260. In FIG. 16B, a seamless positioning holder 241 has been molded onto exposed portions of the leads 261 and 262 of the intermediate assembly 280 of FIG. 16A.

While certain embodiments have been described, these embodiments have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Certain terminology may be used in the following description for the purpose of reference only, and thus is not intended to be limiting. For example, terms such as "upper", "lower", "upward", "downward", "above", "below", "top", "bottom", "left", and similar terms refer to directions in the drawings to which reference is made. Such terminology may include the words specifically mentioned above, derivatives thereof, and words of similar import. Similarly, the terms "first", "second", and other such numerical terms referring to structures neither imply a sequence or order unless clearly indicated by the context.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "spherical" or "circular" or "cylindrical" or "semi-circular" or "semi-cylindrical" or any related or similar terms, are not required to conform strictly to the mathematical definitions of spheres, circles, cylinders or other structures, but can encompass structures that are reasonably close approximations.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees. As another example, in certain embodiments, as the context may permit, the term "generally perpendicular" can refer to something that departs from exactly perpendicular by less than or equal to 20 degrees.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Although the invention has been disclosed in the context of certain embodiments and examples, it will be understood by those skilled in the art that this disclosure extends beyond the specifically disclosed embodiments to other alternative embodiments and/or uses of the embodiments and certain modifications and equivalents thereof. The scope of the present disclosure is not intended to be limited by the specific disclosures of preferred embodiments in this section or elsewhere in this specification, and may be defined by claims as presented in this section or elsewhere in this specification or as presented in the future.

What is claimed is:

1. A flameless candle device, comprising:

a flame-simulating element, comprising:

a cover defining a hollow cavity therein; and a flexible light-emitting diode (LED) bulb disposed within the hollow cavity, the flexible LED bulb comprising:

a light-emitting section positioned within the cavity, wherein a first portion of the light emitting section of the flexible LED bulb extends generally parallel to a second portion of the light emitting section of the flexible LED bulb, a first bulb lead extending from the first portion of the light emitting section of the flexible LED bulb, and a second bulb lead extending from the second portion of the light emitting section of the flexible LED bulb; and a wick-simulating element supporting the flame-simulating element, the wick-simulating element comprising first and second discrete channels extending therethrough, wherein the first bulb lead extending from the first portion of the light emitting section of the flexible LED bulb extends through the first discrete channel and wherein the second bulb lead extending from the second portion of the light emitting section of the flexible LED bulb extends through the second discrete channel.

2. The device of claim 1, wherein the cover comprises an upper cover section and a lower cover section, the wick-simulating element extending through an aperture in the lower cover section.

3. The device of claim 2, wherein the upper cover section is more opaque than the lower cover section.

4. The device of claim 2, wherein the lower cover section is substantially transparent.

5. The device of claim 2, wherein an inner surface of the upper cover section comprises a diffusive texture.

6. The device of claim 1, additionally comprising a positioning holder supporting the wick-simulating element, wherein the first and second bulb leads are retained within the positioning holder.

7. The device of claim 6, additionally comprising a candle shell, wherein the positioning holder is embedded at least partially within the candle shell.

8. The device of claim 7, additionally comprising:

a circuit board disposed within the candle shell and in electrical connection with the flexible LED bulb through the positioning holder; and a power supply structure disposed at least partially within the candle shell.

9. The device of claim 1, wherein the wick-simulating element comprises an integral structure defining the first and second discrete channels extending therethrough.

10. A flameless candle device, comprising:

a cover, comprising:

an upper cover section; and a lower cover section secured relative to the upper cover section to define a hollow cavity and a flexible light-emitting diode (LED) bulb disposed within the hollow cavity, the flexible LED bulb comprising an elongated U-shape, a first end of the LED bulb terminating in a positive lead and a second end of the LED bulb terminating in a negative lead;

a candle housing;

a tube supporting the LED bulb away from the candle housing; and a positioning holder supporting the tube, the positioning holder disposed at least partially within the candle housing, the first lead and the second lead of the LED bulb extending through the tube and into the positioning holder.

11. The device of claim 10, wherein the positioning holder comprises a first receptacle configured to receive and retain the first lead extending from the LED bulb, and a second receptacle configured to receive and retain the second lead extending from the LED bulb.

12. The device of claim 11, wherein the tube is an integral structure comprising a first channel through which the first lead extends and a second channel through which the second lead extends, the first and second channels separated from one another along at least a portion of the length of the tube by an internal divider.

13. The device of claim 11, wherein the positioning holder comprises a first internal connection between the first lead and a first wire extending from the positioning holder and a second internal connection between the second lead and a second wire extending from the positioning holder.

14. The device of claim 13, wherein the first receptacle comprises a push-in receptacle in electrical communication with the first wire, and wherein the second receptacle comprises a push-in receptacle in electrical communication with the second wire.

15. A flameless candle device, comprising:

a flame-simulating element, comprising:

a cover, comprising a hollow cavity and a flexible light-emitting diode (LED) bulb disposed within the hollow cavity, a first end of the flexible LED bulb comprising a positive lead extending therefrom and a second end of the flexible LED bulb comprising a negative lead extending therefrom;

a wick-simulating element supporting the flame-simulating element, the wick-simulating element being a contiguous structure, the wick-simulating element comprising an insulating sheath defining a first discrete passage through which the positive lead extends and defining a second discrete passage through which the negative lead extends; and a positioning holder supporting the wick-simulating element, the positioning holder disposed at least partially within the candle housing.

16. The device of claim 15, wherein the positioning holder comprises a first positioning holder component configured to engage with a second positioning holder component to retain portions of the positive and negative leads therebetween.

17. The device of claim 15, additionally comprising an internal sleeve disposed within the hollow cavity and surrounding at least a portion of the flexible LED bulb to prevent contact between the flexible LED bulb and the cover.

18. The device of claim 15, wherein an interior surface of the cover comprises a diffusive texture.

19. The device of claim 15, additionally comprising a printed circuit board and a power supply component in electrical communication with the LED bulb.

20. The device of claim 19, wherein the power supply component comprises a lightbulb base.

21. The device of claim 19, wherein the power supply component comprises a power cord.

22. A method of assembling a flameless candle component, comprising:

inserting a first lead of a flexible light-emitting diode (LED) bulb into a first channel within a supporting tube, a first end of the flexible LED bulb terminating in the first lead and a second end of the flexible LED bulb terminating in a second lead, the supporting tube comprising an integral structure defining the first channel and a second channel at least partially separated from the first channel by an internal divider within the supporting tube, an exposed section of the first lead extending from an end of the supporting tube opposite the LED bulb;

inserting the second lead of the flexible LED bulb into the second channel within the supporting tube, an exposed section of the second lead extending from an end of the supporting tube opposite the LED bulb;

inserting a portion of the supporting tube through an aperture in a light-transmissive component of a cover configured to encapsulate the LED bulb; and forming a positioning holder retaining a portion of each of the exposed sections of the first and second leads.

23. The method of claim 22, wherein forming a positioning holder retaining a portion of each of the exposed sections of the first and second leads comprises forming a seamless positioning holder encapsulating the retained portions of each of the exposed sections of the first and second leads.

24. The method of claim 23, wherein forming a seamless positioning holder comprises molding a seamless positioning holder around the retained portions of each of the exposed sections of the first and second leads, after the supporting rube has been inserted through the aperture in the light-transmissive component of the cover.

25. The method of claim 22, wherein the forming a positioning holder retaining a portion of each of the exposed sections of the first and second leads comprises assembling a first discrete positioning holder component and a second discrete positioning holder component to retain the retained portion of each of the exposed sections of the first and second leads therebetween.

* * * * *